US005709361A

United States Patent [19]

Dalisy

[11] Patent Number: 5,709,361

[45] Date of Patent: Jan. 20, 1998

[54] FAN SUPPORT MEMBER

[75] Inventor: George Dalisy, Hollywood, Fla.

[73] Assignee: Racal-Datacom, Inc., Sunrise, Fla.

[21] Appl. No.: 594,629

[22] Filed: Feb. 2, 1996

[51] Int. Cl.[6] ..... A47F 5/00

[52] U.S. Cl. ..... 248/300; 248/131; 361/697

[58] Field of Search ..... 248/300, 299, 248/229.26, 906, 346.04, 316.1, 316.4, 674; 361/695, 697

[56] References Cited

U.S. PATENT DOCUMENTS

| | | | |
|---|---|---|---|
| 2,681,164 | 6/1954 | Kalfen | 248/300 |
| 2,873,082 | 2/1959 | Gillespie | 248/300 |
| 4,390,105 | 6/1983 | Graves | 248/906 |
| 5,368,262 | 11/1994 | Garrity | 248/131 |
| 5,448,495 | 9/1995 | Liu | 361/683 |
| 5,566,749 | 10/1996 | Jordan et al. | 361/697 X |
| 5,590,025 | 12/1996 | Clemens | 361/695 |

*Primary Examiner*—Leslie A. Braun
*Assistant Examiner*—Anita M. King
*Attorney, Agent, or Firm*—Pedro P. Hernandez

[57] ABSTRACT

A fan support member (100) includes first (102) and second (104) cantilevered members extending from base member (116). In one embodiment, each of the cantilevered members (102 and 104) includes at least one retention member (106, 108, 110 and 112) which engage to corresponding recess locations (302, 304, 306 and 308) located on the fan (300). The cantilevered members (102 and 104) become loaded when a fan is placed between them causing them to press against the sides (312 and 314) of the fan (300) which helps keep the fan(300) securely attached. The fan support member (100) allows for quick attachment and removal of fan (300).

5 Claims, 3 Drawing Sheets

FAN SUPPORT MEMBER

FIELD OF THE INVENTION

This invention relates in general to the field of support members and more particularly, to a member used for supporting an electric fan.

BACKGROUND OF THE INVENTION

Electronic devices such as computers and data communication products which dissipate heat typically use internal electric fans to help prevent overheating. These fans help prevent damage to sensitive internal electronic components by helping to dissipate heat away from the sensitive electronic components.

A common method of mounting electric fans is to use conventional fasteners such as screw or rivets. Typically, the electric fan is secured directly to the electronic device's housing using multiple screws and nuts, or rivets. Using conventional fasteners is however labor intensive which causes the manufacturing cost of the electronic device to increase.

If an electric fan ever became damaged, either during the course of manufacture or after the electronic device was in service, all of the fasteners supporting the fan would have to be removed in order to replace the damaged fan. A replacement fan would then have to be reattached using multiple fasteners. A need thus exists in the art for a fan support member which allows for quick attachment and reattachment of a fan.

SUMMARY OF THE INVENTION

The present invention provides an improved fan support member which allows for a fan to be quickly attached and removed. The fan support member includes opposed cantilevered arms which help secure the fan. In another embodiment of the invention, a fan assembly includes a fan and a fan support member which allows for quick attachment and removal of the fan.

DETAILED DESCRIPTION OF THE INVENTION

Figure 1:
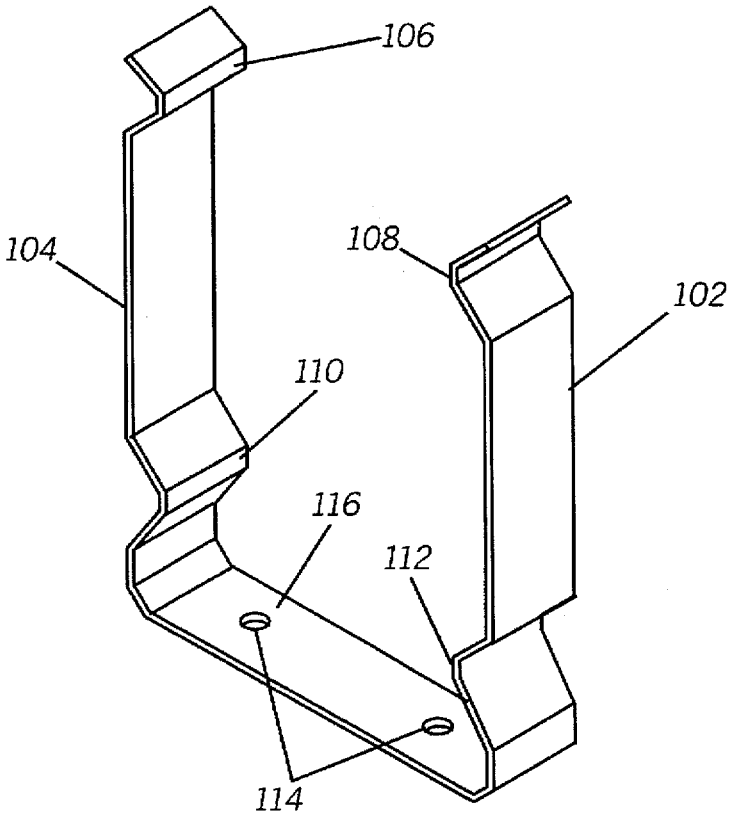
FIG. 1 shows a perspective view of a fan support member in accordance with the present invention.

Referring now to the drawings and in particular to FIG. 1, there is shown a first embodiment of a fan support member 100 in accordance with the present invention. Fan support member 100 is preferably made from spring-tempered steel which is shaped as shown in FIG. 1. Other materials which are resilient and which can provide mechanical biasing such as stainless steel, certain types of plastics, or other well known metals and metal alloys, can also be used to practice the invention. In the preferred embodiment, the support member 100 is formed from a single piece of metal which is formed by using conventional cutting, bending and stamping techniques as known in the art. The spring-tempered steel forming support member 100 is approximately 0.036 inch (0.091 centimeter) thick and approximately 0.55 inch (1.4 centimeter) wide. The length and thickness of the support member which is designed can be modified as appropriate in order to accommodate fans having different shapes and sizes.

Fan support member 100 comprises a base member 116 and first 102 and second 104 cantilevered members or support arms extending from opposite ends of the base member 116. Support arms 102 and 104 act as spring fingers which provide inward bias against the electric fan's frame, when the fan is placed between the arms 102 and 104. Base member 116 preferably includes one or more apertures 114 which are used for accommodating fasteners such as screws or rivets which are used to retain the support member to the electronic device. Instead of using conventional fasteners, base member 116 could be welded or adhesively attached to the electronic device. For example, if the support member were manufactured from a resilient plastic, the plastic base member could be ultrasonically welded or adhesively bonded to the electronic device.

The first cantilevered support arm 102 includes first 108 and second 112 retention means or members. The retention means in the preferred embodiment are bends in support arm 102 which form raised protrusions or catches which are used to engage slots or recess locations located on the sides of the electric fan's frame. Similarly, the second cantilevered support arm 104 includes first 106 and second 110 retention means which engage slots on the opposite side of the electric fan's frame. In the preferred embodiment, the first 102 and second 104 support arms are substantial mirror images of each other since both have two bends (106 and 110, and 108 and 112) and the bends are aligned at the same height from base member 116.

Figure 3:
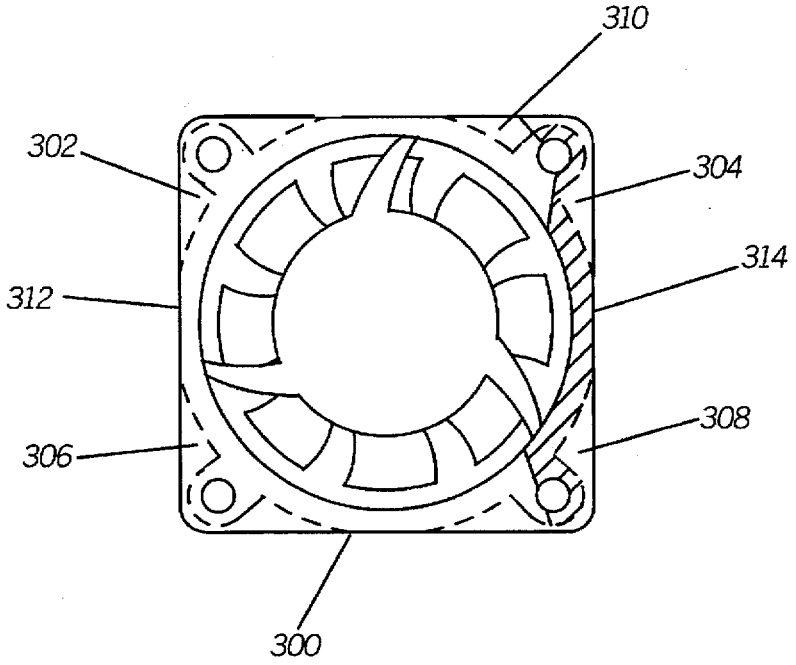
FIG. 3 shows an electric fan such as those which are supported by the support member of FIG. 1.

FIG. 3 shows an electric fan 300 such as those which can be retained by support member 100. Preferably, electric fan 300 is substantially square in shape and includes first 302 and second 306 recess locations on a first side 312 and first 304 and second 308 recess locations on a second 314 or opposite side of fan frame 310. The front portion of the right side of the fan frame 310 is shown removed in FIG. 3 in order to highlight the recess areas 304 and 308. In the preferred embodiment, fan 300 has a thickness of approximately 0.75 inch (1.9 centimeter) and a width of approximately 2.375 inch (6.03 centimeter).

Figure 4:
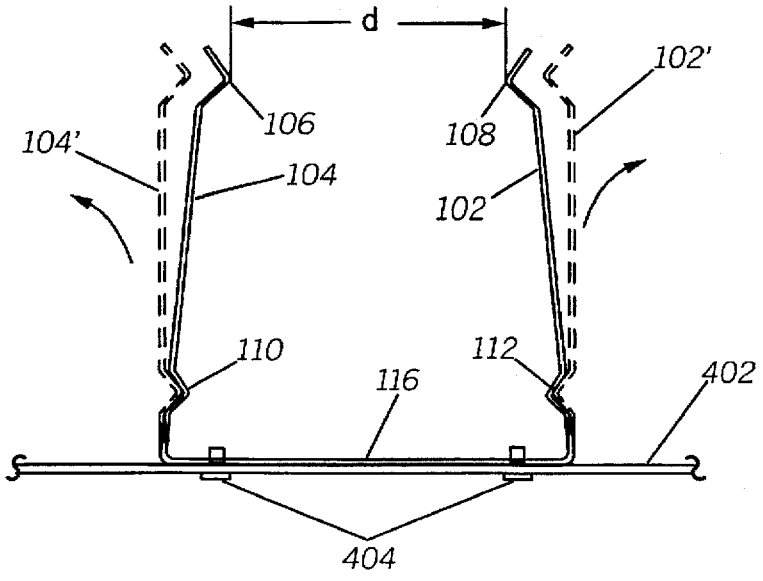
FIG. 4 shows a support member attached to an electronic device housing in accordance with the invention.

Referring now to FIG. 4, support member 100 is shown attached to an electronic device housing 402. In the preferred embodiment, base member 116 is attached to the housing 402 using two rivets 404 which are passed through apertures 114. Although FIG. 4 shows the support member 100 attached to a portion of an electronic device's housing 402, support member 100 could also be attached to a printed circuit board or other member which is part of the electronic device.

When the electric fan 300 is inserted into support member 100, first 102 and second 104 cantilevered support arms are pushed out and become loaded by the fan's frame sides 312 and 314 to the extended positions referenced as 102' and 104'. This is the case since in the rest position, the distance "d" between the protrusions 106 and 108 is approximately 1.875 inch (4.76 centimeter). When the bottom portion of the fan frame 310 comes in proximity to base member 116, the protrusions or catches (106–112) located on the first and second support arms 102 and 104 become aligned with recesses (302–308) located on first 312 and second 314 sides of fan 300 causing the first and second support arms 102 and 104 to spring back towards the sides 312 and 314 of fan 300. Once the support arms spring back, each of the protrusions (106–112) rest within the corresponding recess locations (302–308) located on fan frame member 310 and provide support for the fan 300. The support arms 102 and 104 provide both side-to-side and front-to-back support for fan 300.

Although the preferred embodiment shows the fan 300 having recess locations (302–308) and the support arms having the catches or protrusions (106–112) which engage the recess locations, this could easily be reversed. For example, the fan frame 310 could have protrusions and the support arm could be designed to have recesses by reversing the bends on the support arms (i.e., the bottom portion of the bends would point to the outer sides of the support arms).

Figure 2:
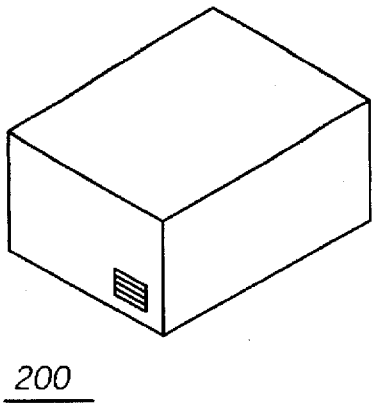
FIG. 2 shows an electronic device which uses the fan support assembly of the present invention.
Figure 5:
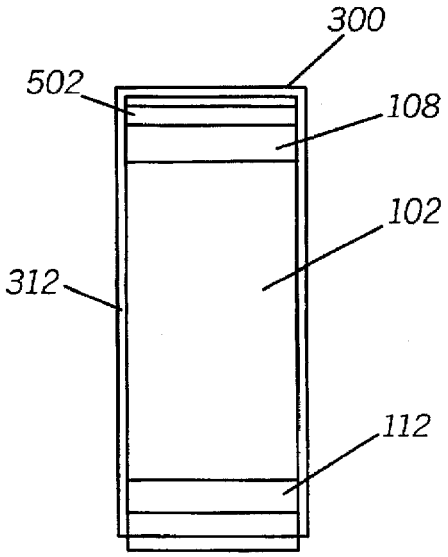
FIG. 5 shows a side view of the fan support member of FIG. 1 retaining the electric fan shown in FIG. 3 in accordance with the invention.

In FIG. 2, an electronic device such as a data communication device 200 having a fan assembly in accordance with the present invention is shown. In FIG. 5, a side view of a fan assembly with one of the support arms 102 latched onto one side 312 of fan 300 is shown. The end portion of bend 108 at the free end of support arm 102 provides for a raised portion 502 which provides for easy removal of the support arm 102 from fan side 312. The raised portion 502 allows a person to pry away the support arm 102 in order to disengage retention members 108 and 112.

Figure 6:
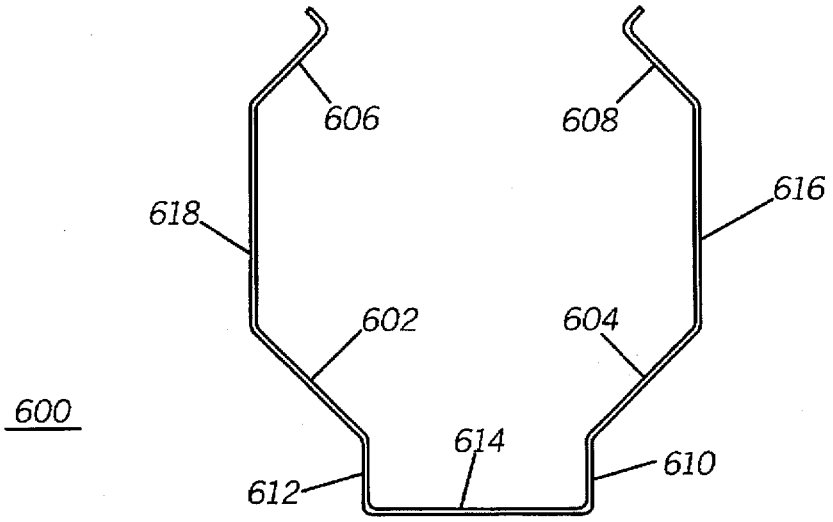
FIG. 6 shows a second embodiment of a fan support member in accordance with the present invention.

Referring now to FIG. 6, a second embodiment of a fan support member in accordance with the present invention is shown. Fan support member 600 instead of using protrusions as shown in fan support 100 for the retention members uses a series of angled members 602–608 which wrap around the fan to be supported. The angled member 602–608 form an octagonal shaped area having openings in the top and bottom for receiving a fan. Similar to the first embodiment, first and second 616 and 618 support arms provide inward pressure against the sides of the fan to be supported. Fan support member 600 also includes height extension members 610 and 612 which allow the fan to be raised above the base member 614.

Figure 7:
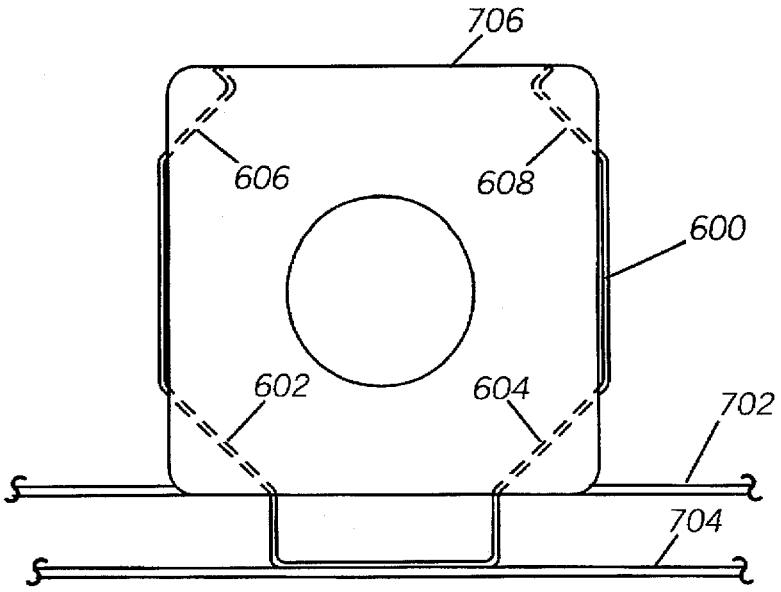
FIG. 7 shows a fan assembly using the fan support member shown in FIG. 6 attached to an electronic device in accordance with the invention.

In FIG. 7, the fan support member 600 is shown attached to an electronic device housing 704. Fan support member 600 supports fan 707 above the base member 616 so that it can be placed in closer proximity to the electronic components found in printed circuit board 702. FIG. 7 shows how the retention members (angled members 602–608) conform around the sides of fan 706 and help retain the fan 706 in proper alignment.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A fan assembly comprising:

a fan having an outer surface;

a fan support member, including:

a base member;

first and second resilient cantilevered members extending from opposite ends of the base member, the first and second cantilevered members oppose each other and the fan is located between the first and second cantilevered members such that they exert an inward pressure against the fan;

a fan retention means located in each of the first and second resilient cantilevered members for retaining the fan between the first and second resilient cantilevered members, the retention means located in each of the first and second resilient cantilevered members comprise a plurality of angled sections which conform to portions of the outer surface of the fan; and height extension sections located between the base member and the angled sections located in both the first and second cantilevered members, the height extension sections raise the fan above the base member.

2. The fan assembly as defined in claim 1, wherein the angled sections located in the first and second resilient cantilevered members form a substantially octagon shaped fan support area.

3. The fan assembly as defined in claim 1, wherein the fan support member is formed from a single piece of spring-tempered steel.

4. The fan assembly as defined in claim 1, wherein the first and second cantilevered members each include a free end and each of the free ends of the first and second cantilevered members are bent outward away from the fan in order to provide a raised portion which allows the cantilevered members to be pried away from the fan.

5. The fan assembly as defined in claim 1, wherein the fan has opposite sides each having a recess location and the fan retention means located on the first cantilevered member engages with the recess location located on one of the sides of the fan and the fan retention means located on the second cantilevered member engages with the recess location located on the opposite side of the fan.

* * * * *